US006412573B2

(12) United States Patent
Vaynshteyn

(10) Patent No.: US 6,412,573 B2
(45) **Date of Patent: *Jul. 2, 2002**

(54) SYSTEM FOR INDICATING THE FIRING OF A PERFORATING GUN

(75) Inventor: Vladimir Vaynshteyn, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,098

(22) Filed: Dec. 12, 2000

Related U.S. Application Data

(63) Continuation of application No. 09/310,671, filed on May 12, 1999, now Pat. No. 6,179,064, which is a continuation-in-part of application No. 09/121,192, filed on Jul. 22, 1998, now Pat. No. 6,105,688.

(51) Int. Cl.[7] ..... E21B 43/117

(52) U.S. Cl. ..... 175/4.54

(58) Field of Search ..... 166/55.1, 297, 166/251.1, 299, 55, 66, 66.4–5; 175/4.52, 4.54, 4.56, 4.51, 55, 66, 66.4, 66.5, 316, 332

(56) References Cited

U.S. PATENT DOCUMENTS

| | | | | | |
|---|---|---|---|---|---|
| 5,343,963 | A | * | 9/1994 | Bouldin et al. | 175/27 |
| 5,490,563 | A | * | 2/1996 | Wesson et al. | 166/297 |
| 6,021,095 | A | * | 2/2000 | Tubel et al. | 367/82 |
| 6,041,864 | A | * | 3/2000 | Patel et al. | 166/332.4 |
| 6,055,213 | A | * | 4/2000 | Rubbo et al. | 367/82 |

* cited by examiner

*Primary Examiner*—Robert E. Pezzuto
(74) *Attorney, Agent, or Firm*—Trop, Pruner & Hu P.C.

(57) ABSTRACT

A system for use in a subterranean well includes a tubing, a perforating gun, a detonator and circuitry. The detonator is adapted to fire the perforating gun. The circuitry is adapted to determine whether the perforating gun has fired and based on the determination, operate a valve of the tubing to transit a stimulus to the surface of the well to indicate whether the perforating gun has fired.

37 Claims, 13 Drawing Sheets

| COMMAND | NAME | CODES |
|---|---|---|
| 0 | ID | S1111 1000:1111 0111 |
| 1 | NEXT_GUN | S1111 1001:1111 0110 |
| 2 | FIRE GUN | S1010 1010: 0101 0101 |

*FIG. 5*

| STATUS | NAME | CODES |
|---|---|---|
| 0 | PRESENCE | S1000 |
| 1 | NEXT | S1001 |
| • | • | • |
| • | • | • |
| • | • | • |
| 7 | ISSC_ERROR | S1111 |

*FIG. 6*

| BYTE | NAME | RESPONSE/RANGE |
|---|---|---|
| 0 | Acknowledge | S00001000 |
| 1 | Year | 96 TO 199 CON. TO HEX |
| 2 | Week | 1 TO 52 CON. TO HEX |
| 3 | Serial Number | 0 TO 254 CON. TO HEX |
| 4 | Ver High Byte | 1 TO FF CON. TO HEX |
| 5 | Ver Low Byte | 0 TO FF HEX |
| 6 | Checksum_sn | 0 TO FF HEX |

*FIG. 7*

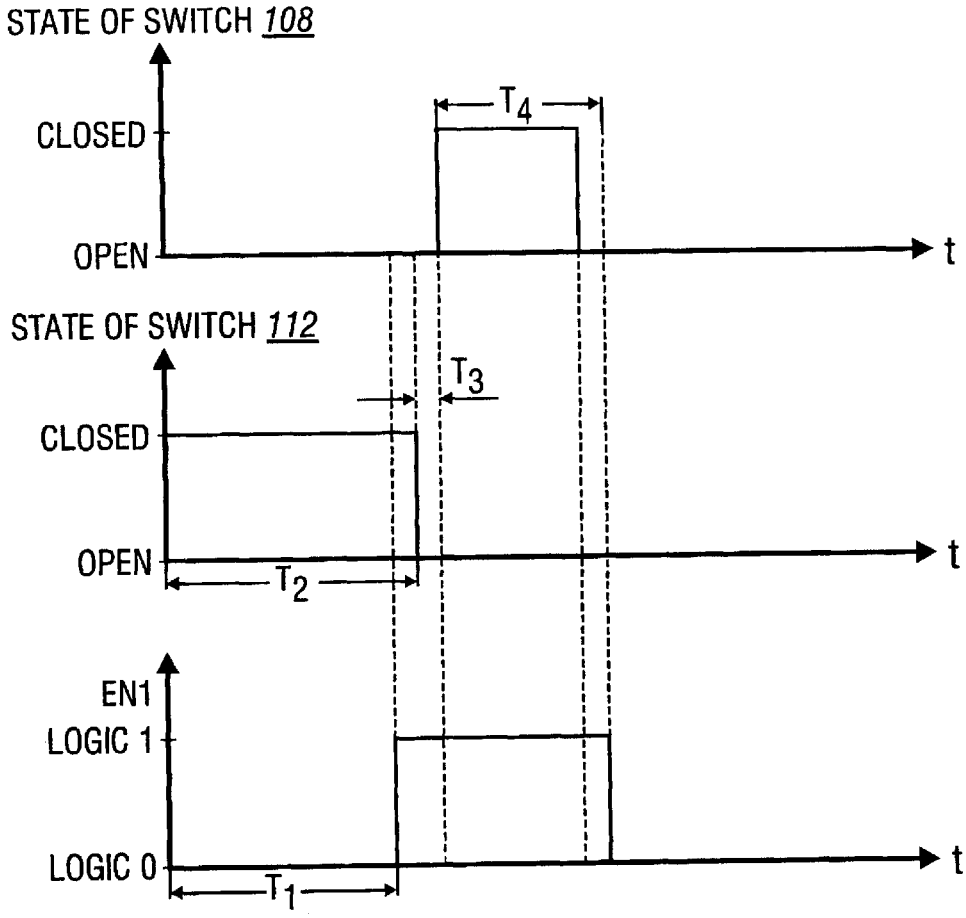
FIG. 10
FIG. 11
FIG. 12
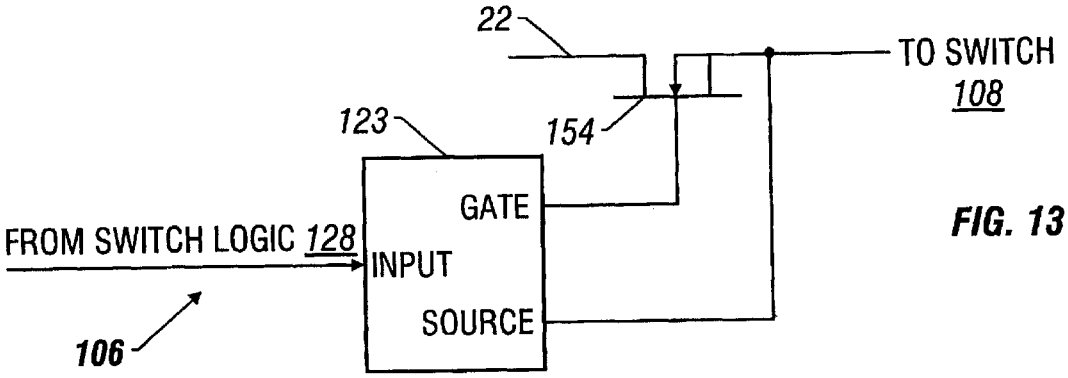
FIG. 13
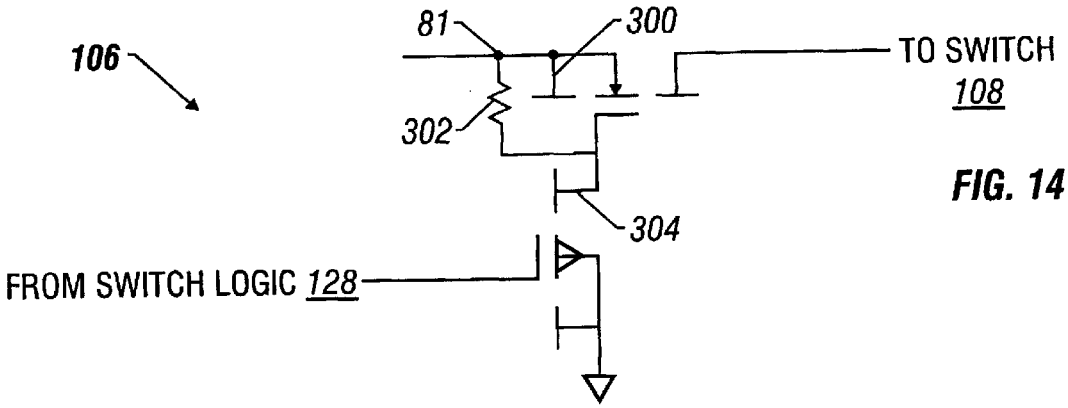
FIG. 14

SYSTEM FOR INDICATING THE FIRING OF A PERFORATING GUN

CROSS-REFERENCE TO RELATED APPLICATIONS

This is a continuation of U.S. patent application Ser. No. 09/310,671 that was filed May 12, 1999; now U.S. Pat. No. 6,179,064, which is a continuation-in-part of U.S. patent application Ser. No. 09/121,192 that was filed Jul. 22, 1998 now U.S. Pat. No. 6,105,688.

BACKGROUND

The invention relates to a system for indicating the firing of a perforating gun.

Referring to FIG. 1, a typical perforating gun string 10 may have several perforating guns 12. Each perforating gun 12 may have phased shaped charges 14 that are used to penetrate a casing of a subterranean well and form fractures in surrounding formations to enhance the production of well fluids from these formations. Because the shaped charges 14 may potentially inflict harm if the charges 14 prematurely detonate, several safety mechanisms typically are used to prevent accidental detonation of the shaped charges 14.

For example, the shaped charges 14 may use detonators that are constructed with secondary explosives that, as compared to primary explosives, are very difficult to detonate. To detonate these type of detonators, the perforating gun string 10 may include a firing head 11 that is associated with each perforating gun 12. In this manner, the firing head 11 may include a detonator 15 that, when activated, detonates a secondary explosive to initiate a shockwave on a detonating cord 17 that extends to the shaped charges 14. The shockwave, in turn, propagates down the detonating cord 17 and detonates the shaped charges 14.

The detonation of the perforating gun 12 may be remotely controlled from the surface of the well. To accomplish this, stimuli may be transmitted downhole to the firing head 11 to cause the detonator 15 to initiate the shockwave on the detonating cord 17. As examples of techniques that are used to transmit the stimuli, an internal passageway of the string 10, an annulus that surrounds the string 10, a tubing of the string 10, or a line (a slickline or a wireline, as examples) extending downhole may all be used. Other techniques may also be used to transmit command stimuli downhole.

Detonation of the primary explosive typically requires energy from an energy source, a source that may either be located at the surface of the well or downhole in the perforating gun string 10. If the energy source is at the surface of the well, then an operator may disconnect the energy source until firing of the perforating guns 12 is desired. However, unfortunately for the other case, connection/disconnection of a downhole energy source may present difficulties, as circuitry (not shown) of the firing head 11 must connect/disconnect the energy source. For example, a battery 16 of the string 10 may provide the energy needed to cause the detonator 15 to initiate a shockwave on the detonating cord 17. However, a problem with this arrangement is that the battery 16 is located downhole with the detonator 15. Thus, if the circuitry that couples the battery 16 to the detonator 15 should fail, the shaped charges 14 may be inadvertently detonated.

An operator at the surface of the well needs to know if the firing of a particular perforating gun 12 is successful. If not, then the operator may attempt to fire the perforating gun 12 again or disarm the perforating gun 12 before retrieving the gun 12. When the perforating gun 12 is attached to a tubing, one way to determine whether the perforating gun 12 fired is to place sensors on the tubing at the surface and monitor the acoustic energy that emanates from the tubing. However, this technique is not always reliable due to the length of the string and the contact between the string and the casing of the well, factors that may greatly attenuate acoustic signals that propagate uphole.

Thus, there is a continuing need to address one or more of the above-stated problems.

SUMMARY

In one embodiment of the invention, a system for use in a subterranean well includes a tubing, a perforating gun, a detonator and circuitry. The detonator is adapted to fire the perforating gun. The circuitry is adapted to determine whether the perforating gun has fired and based on the determination, operate a valve of the tubing to transmit a stimulus to the surface of the well to indicate whether the perforating gun has fired.

Other embodiments will become apparent from the following description, from the drawing and from the claims.

BRIEF DESCRIPTION OF THE DRAWING

FIGS. 5, 6 and 7 are charts illustrating information communicated between a fire control circuit and detonators of FIG. 4.

FIGS. 10, 11 and 12 are timing diagrams illustrating signals generated by the fire control circuit.

FIGS. 13 and 14 are alternative electrical schematic diagrams of a switch of FIG. 9.

DETAILED DESCRIPTION

Figure 1:
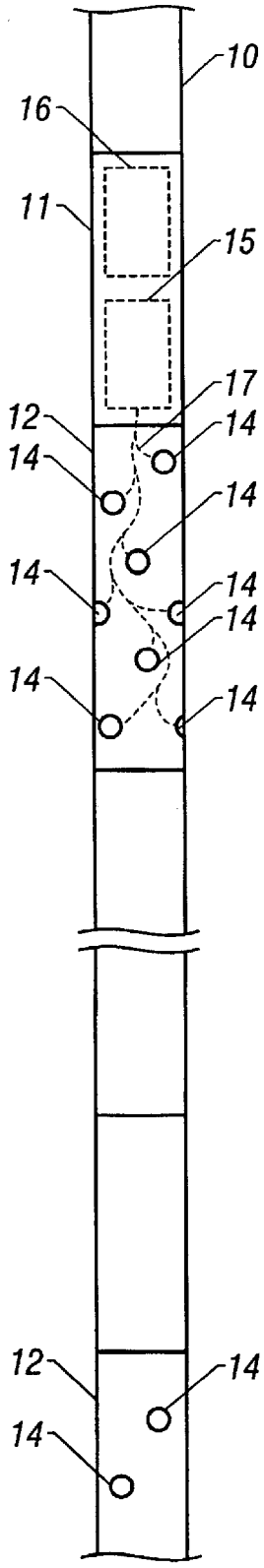
FIG. 1 (PRIOR ART)
FIG. 1 is a schematic view of a perforating gun string of the prior art.
Figure 2:
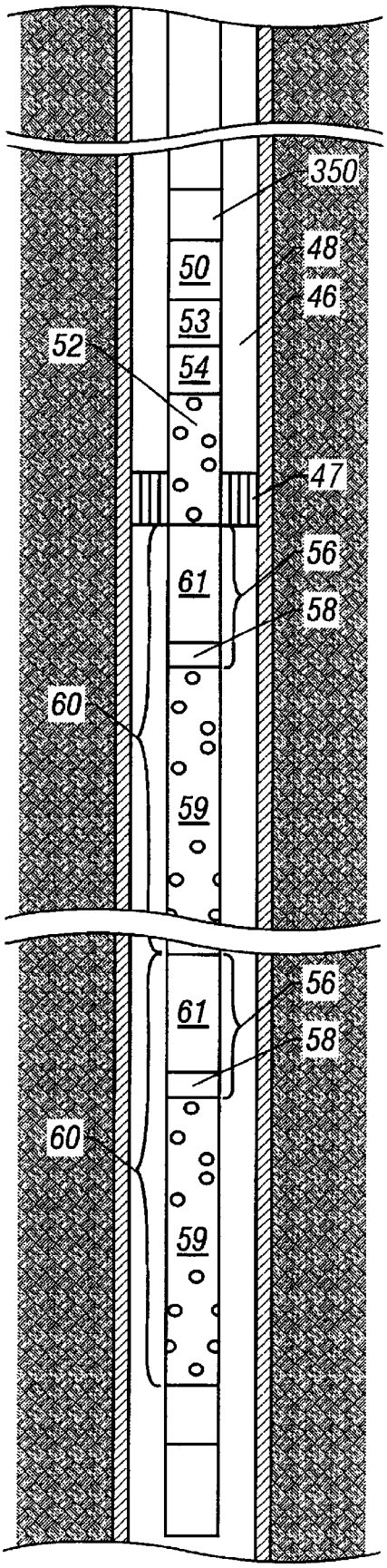
FIG. 2 is a view of a perforating gun string according to an embodiment of the invention.

Referring to FIG. 2, in a subterranean well, an embodiment 50 of a tubular perforating gun string in accordance with the invention includes a battery 52 that may be used to fire multiple perforating guns 59 of the gun string 50. Although each perforating gun 59 is fired by an associated electrical detonator, or initiator module 56 (of the gun string 50), the battery 52 remains electrically isolated from the initiator modules 56 until a unique detonation command (i.e., a command used for no other purpose than detonation) is sent from the surface of the well to begin a firing sequence for the guns 59. To accomplish this, the perforating gun string 50 includes a fire control circuit 54 that controls the connection of the battery 52 to the initiator modules 56. The fire control circuit 54, in turn, includes redundant circuits (described below) that independently verify the reception of the detonation command before the initiator modules 56 are connected to the battery 52.

Figure 4:
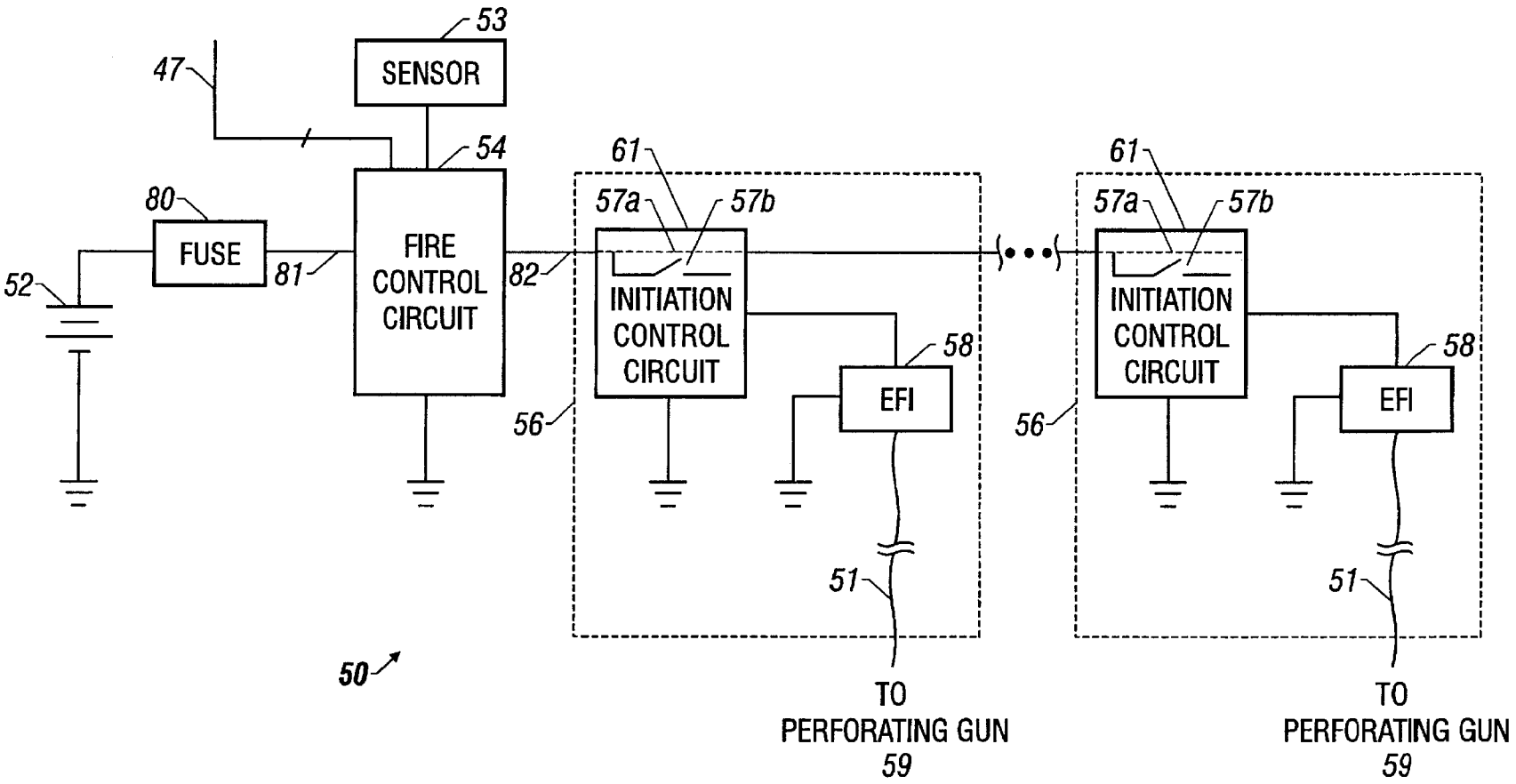
FIG. 4 is an electrical schematic diagram of the perforating gun string of FIG. 2.

In some embodiments, the perforating gun string 50 may include multiple perforating gun assemblies 60. In this manner, each assembly 60 may include one initiator module 56 and one perforating gun 59. Referring also to FIG. 4, after reception of the detonation command is verified, the fire control circuit 54 selectively transmits commands (described below) to the initiator modules 56. In response, an initiation control circuit 61 of a selected initiator module 56 fires the associated gun 59 by activating an exploding foil initiator (EFI) 58 of the initiator module 56. When activated, the EFI 58 initiates a shockwave on an associated detonating cord 51 that extends to shaped charges of the associated gun 59. The shockwave from the detonator cord 51 fires the shaped charges, and thus, fires the gun 59.

As described below, the string 10 may include circuitry that is located downhole in the approximate vicinity of the perforating guns 59. In this manner, the circuitry may detect the firing of a particular perforating gun 59 and use a valve to transmit a stimulus uphole to indicate the firing of the perforating gun 59. Due to this arrangement, a stronger indication of the firing is received at the surface of the well. This is in contrast to conventional systems in which such factors as the length of the string and contact between the string and the casing cause large attenuation of the acoustic energy that propagates uphole, thereby making the firing of the perforating gun harder to detect.

In some embodiments, after the fire control circuit 54 causes a particular initiator module 56 to fire its associated perforating gun 59, a circulation valve module 350 (of the gun string 50 ) that is located downhole (in the vicinity of the perforating guns 59) may detect the firing of the perforating gun 59 and transmit a stimuli uphole. In this manner, the valve module 350 is used to selectively alter fluid communication between the central passageway of the string 50 and the annulus 46 to indicate that the perforating gun 59 has been fired. As depicted in FIG. 2, in some embodiments, the circulation valve module 350 may be located above a packer 47.

In some embodiments, the fire control circuit 54 may detect the firing and control the circulation valve module 350 to transmit the stimuli uphole. This arrangement may include wires that extend through the packer 47 and electrically couple the circulation valve module 350 and the initiator modules 56 for purposes of directly communicating the firing of a perforating gun 59 to the circulation valve module. In some embodiments, the fire control circuit 54 may use a power line 82 (see FIG. 4) to serially communicate with a particular initiator module 56 for purposes of instructing the initiator module 56 to fire its associated perforating gun 59. The firing of the perforating gun 59 cuts the power line 82 near the initiator module 56, an event that severs communication between the initiator module 56 and the fire control circuit 54. In some embodiments, the fire control circuit 54 performs a test to determine if a disruption in communication has occurred for purposes of determining whether the perforation gun 59 has fired. In this manner, the fire control circuit 54 first instructs the initiator module 56 to fire its associated perforating gun 59, and subsequently, the fire control circuit 54 attempts to communicate with the initiator module 56. If the initiator module 56 does not respond, then the fire control circuit 54 operates the valve 350 to transmit one or more pressure pulses uphole to indicate that the perforating gun 59 has fired. Alternatively, the fire control circuit 54 may use a sensor (a pressure or acoustic sensor, for example) to detect the firing of a perforating gun 59.

In other embodiments, the circulation valve module 350 operates independently from the fire control circuit 54. In this manner, in these embodiments, the circulation valve module 350 may include a pressure sensor (in contact with the string 50, the fluid in a central passageway of the string 50 or the fluid in the annulus of the string 50, as examples) to independently detect a stimulus that is communicated downhole for purposes of firing a particular perforating gun 59. Afterwards, the circulation valve module 350 may use a sensor (a pressure or acoustic sensor, for example) to detect firing of the perforating gun 59.

The circulation valve module 350 may create the pressure pulses by selectively restricting the flow of fluid between the central passageway of the gun string 50 and an annulus 46 (see FIG. 2) that surrounds the gun string 50. As an example, the circulation valve module 350 may create a pressure pulse to indicate firing of the gun 59 by momentarily decreasing the pressure in the central passageway of the string 50. In this manner, in some embodiments, the central passageway may contain a column of generally stationary fluid, and the circulation valve module 350 creates a negative pressure pulse (as sensed at the surface of the well) by momentarily allowing some of the fluid to escape into the annulus 46. Other embodiments to indicate firing of a perforating gun 59 are described below.

In some embodiments, remote control is used to send commands downhole, as the commands are transmitted to the fire control circuit 54 via stimuli that are transmitted downhole, such as via pressure pulses applied to hydrostatic fluid present in the annulus 46 of the well. The annulus 46 is the annular space accessible from the surface of the well that is between the outside of the string 10 and the interior of a casing 48 of the well. In some embodiments, a duration of the pressure pulse, a pressure of the pressure pulse, and the number of pressure pulses in succession form a signature that uniquely identifies each command. The fire control circuit 54 uses at least one pressure sensor 53 in contact with the hydrostatic fluid in the annulus 46 to receive the commands.

Figure 3:
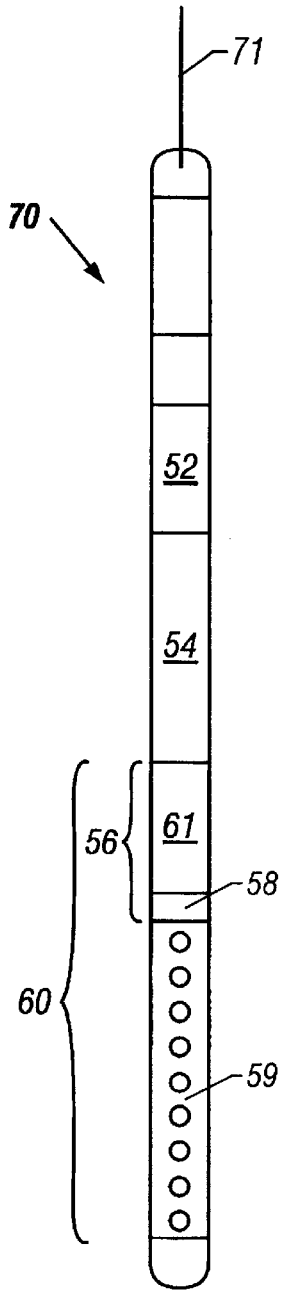
FIG. 3 is a view of a perforating gun tool according to an embodiment of the invention.

Alternatively, in other embodiments, the commands may be transmitted downhole via other types of stimuli. In this manner, stimuli may be transmitted downhole via a passageway of the tubing of the string 10, via a casing of the string 10, or via a downhole line, as a few examples. For the case of the downhole line, a wireline or a slickline, for example, may be used to lower perforating gun assemblies 60 downhole when the assemblies 60 are part of a perforating tool 70 (see FIG. 3). In this manner, the line may impart a predetermined movement (a velocity or an acceleration) on the tool 70. This predetermined movement, in turn, indicates downhole commands, such as the detonation command, that are decoded by a motion sensor (not shown) of the tool 70. Similar to the perforating gun string 50, the tool 70 may have one or more perforating gun assemblies 60, the fire control circuit 54, and the battery 52. The perforating gun tool 70 may be alternatively attached to a coiled tubing which may be used in the ways described above to send stimuli downhole.

Referring back to FIG. 4, the fire control circuit 54 is configured to receive the stimuli transmitted downhole and selectively connect the battery 52 to the initiator modules 56 only if several conditions are met, as described below. Otherwise, the battery 52 remains isolated from the initiator modules 56, and the perforating guns 59 cannot be fired. To accomplish this, the fire control circuit 54 is coupled between the battery 52 and a power line 82 extending to the initiator modules 56. A power line 81 extends between the battery 52 and the fire control circuit 54. If the fire control circuit 54 detects an external fault condition (e.g., the presence of water near circuitry of the tool) or the partial failure of the fire control circuit 54 itself, the fire control circuit 54 shorts the battery 52 to ground which blows a fuse 80 that is serially coupled between the battery 52 and ground. Once the fuse 80 is blown, power from the battery 52 cannot be furnished to the initiator modules 56 which allows the tool 50 to be safely extracted from the well and serviced.

If no fault conditions exist and the fire control circuit 54 is operating properly, then the fire control circuit 54 monitors for transmitted downhole stimuli to detect a detonation command. In some embodiments, the detonation command is a partial key. When the fire control circuit 54 detects a valid (discussed below) detonation command key, the fire control circuit 54 must generate at least three fire control keys. The fire control circuit 54 does not contain within a complete fire key, but only a partial key. In this manner, the partial detonation command key received from the surface must be combined with the internal partial key to form the fire control keys. The importance of this sequence is to prevent the fire control circuit from accidentally jumping to a subroutine and generating a firing sequence without a valid command.

Figure 9:
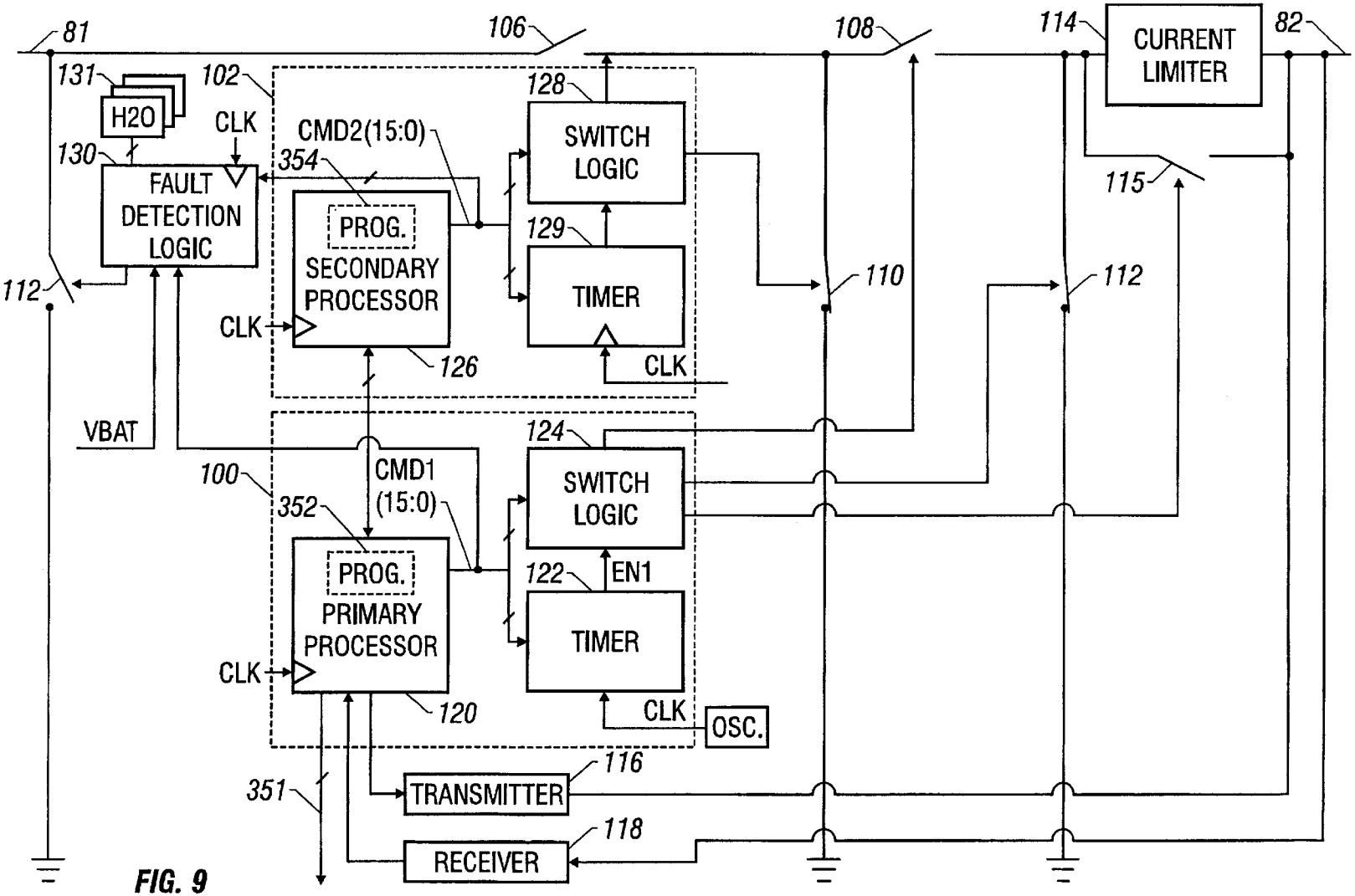
FIG. 9 is an electrical schematic diagram of the fire control circuit of FIG. 4.

Referring also to FIG. 9, after at least three fire control keys are generated, the fire control circuit 54 starts a sequence of events to connect the battery 52 to the power line 82. When a primary processor 120 and a secondary processor 126 have generated at least three keys that may or may not be valid keys, the processors each send out the first key each to start associated synchronous timers, 122 and 129, respectively. Immediately thereafter, the processors 120 and 126 each start firmware timers. If the key was invalid, the hardware will terminate the sequence by blowing the fuse 80 between the battery 52 and fire control circuit 54. If the key was valid, a certain time later, for example 32 seconds, the processors 120 and 126 send out the second key each. If the key is invalid, the hardware will terminate the sequence by blowing the fuse 80 between the battery 52 and fire control circuit 54. If the key is valid, the key will open (unlock) shunt switch(es) 110 and 112 and a certain time later (10 milliseconds (ms), for example), the processors 120 and 126 each send out a third key. If the key is invalid, the hardware will terminate the sequence by blowing the fuse 80 between the battery 52 and fire control circuit 54. If the key is valid, the key will close series switches 106 and 108. The battery 52 is now connected to one of the initiator modules 56, as described below.

Once the battery 52 is connected, the fire control circuit 54 selectively and serially communicates with the initiator modules 56 (via the power line 82) to fire the guns 59. Besides selectively instructing the initiator modules 56 to fire the guns 59, the fire control circuit 54 may also selectively request and receive status information from the initiator modules 56. In some embodiments, the guns 59 may be sequentially fired, beginning with the gun 59 farthest from the surface of the well and ending with the gun 59 closest to the surface of the well. In some embodiments, if the closest gun 59 to the fire control circuit 54 is otherwise fired first, the detonation of the detonation cord and shaped charges will cut the power line 82, and thus, no other gun can be fired. Each initiator module 56 has a mechanism to electrically disconnect the power line 82 from the next gun 59 below.

Although other addressing schemes may be used, in some embodiments, the fire control circuit 54 may communicate with the initiation control circuit 61 of each initiator module 56, one at a time, beginning with the initiation control circuit 61 nearest from the fire control circuit 54. Each initiation control circuit 61 has a switch 57*a* which serially couples the terminals of each initiation control circuit 61 to adjacent initiator modules 56 and a switch 57*b* to connect the power line 82 to circuitry of the initiation control circuit 61. The switches 57*a* and 57*b* closest to the fire control circuit 54 are connected to the power line 82. Initially, all of the switches 57*a* are open which permits the fire control circuit 54 to connect the battery 52 (via the appropriate switch 57*b*) to communicate with the nearest initiator module 56 first.

In communicating with one of the initiator modules 56, the fire control circuit 54 either fires the perforating gun 59 associated with the initiator module 56 or selects the next initiator module 56. When the next gun is selected, the switch 57*a* of the currently selected initiator module 56 closes, and the switch 57*b* of the currently selected initiator module 56 opens. In some embodiments, the above-described process may be used to find the bottom gun 59 and fire this gun 59 first.

Referring to FIG. 5, in some embodiments, the initiation control circuit 61 may perform many operations in response to many different types of commands, which include, as examples, control commands and test commands. Control commands such as ID, NEXT_GUN, and FIRE_GUN, in some embodiments, control primary downhole functions.

The fire control circuit 54 sends either the FIRE_GUN command to actuate the initiation control circuit 61 or the NEXT_GUN command to deselect the initiation control circuit 61 that is currently coupled to the fire control circuit 54. Next, the fire control circuit 54 selects the next farther away (as measured from the fire control circuit 54) initiation control circuit 61 from the deselected initiation control circuit 61. After the bottom gun 59 is found, the fire control circuit 54 transmits the FIRE_GUN command. After the selected initiation control circuit 61 fires the associated perforating gun 59, a new detonation command must be received by the fire control circuit 54 and processed using the above-described technique before firing the next available perforating gun 59.

Referring to FIGS. 6 and 7, the initiation control circuit 61 may, in communications with the fire control circuit 54, communicate status information. After the fire control circuit 54 has detected a valid detonation command and the battery 52 is connected to one of the initiator modules 56, the initiation control circuit 61, when selected, communicates a PRESENCE status to the fire control circuit 54 acknowledging presence and readiness for a command. The initiator module 56 closest to the fire control circuit 54 is selected by default while all others are selected by command. Each command issued by the fire control circuit 54 is answered by the initiation control circuit 61 with an appropriate STATUS or an ERROR STATUS. The primary downhole command acknowledge responses are for ID, NEXT_GUN, FIRE_GUN, and for initiation control circuit error. All other acknowledge responses are for function testing. The ID command initiates an identification (ID) status which causes the initiation control circuit 61 to transmit an acknowledge response, a year and week that the module was manufactured, an indication of a serial number, an indication of a version of the firmware, and a checksum for correct transmission detection.

The NEXT command initiates a bypass of the initiation control circuit 61, and as a result, the next initiator module 56 further form the fire control circuit 54 is selected. The FIRE_GUN command initiates the firing of the associated perforating gun 59. A status is always sent to acknowledge the reception of a command before the initiation control circuit 61 executes the command. A time delay is incorporated between the status acknowledging the reception of a command and the execution of the command by the initiation control circuit 61 which permits the fire control circuit 54 to terminate the execution of the command if the command is incorrect. If the initiation control circuit 61 receives an invalid command, the initiation control circuit 61 returns an ERROR status.

Figure 18:
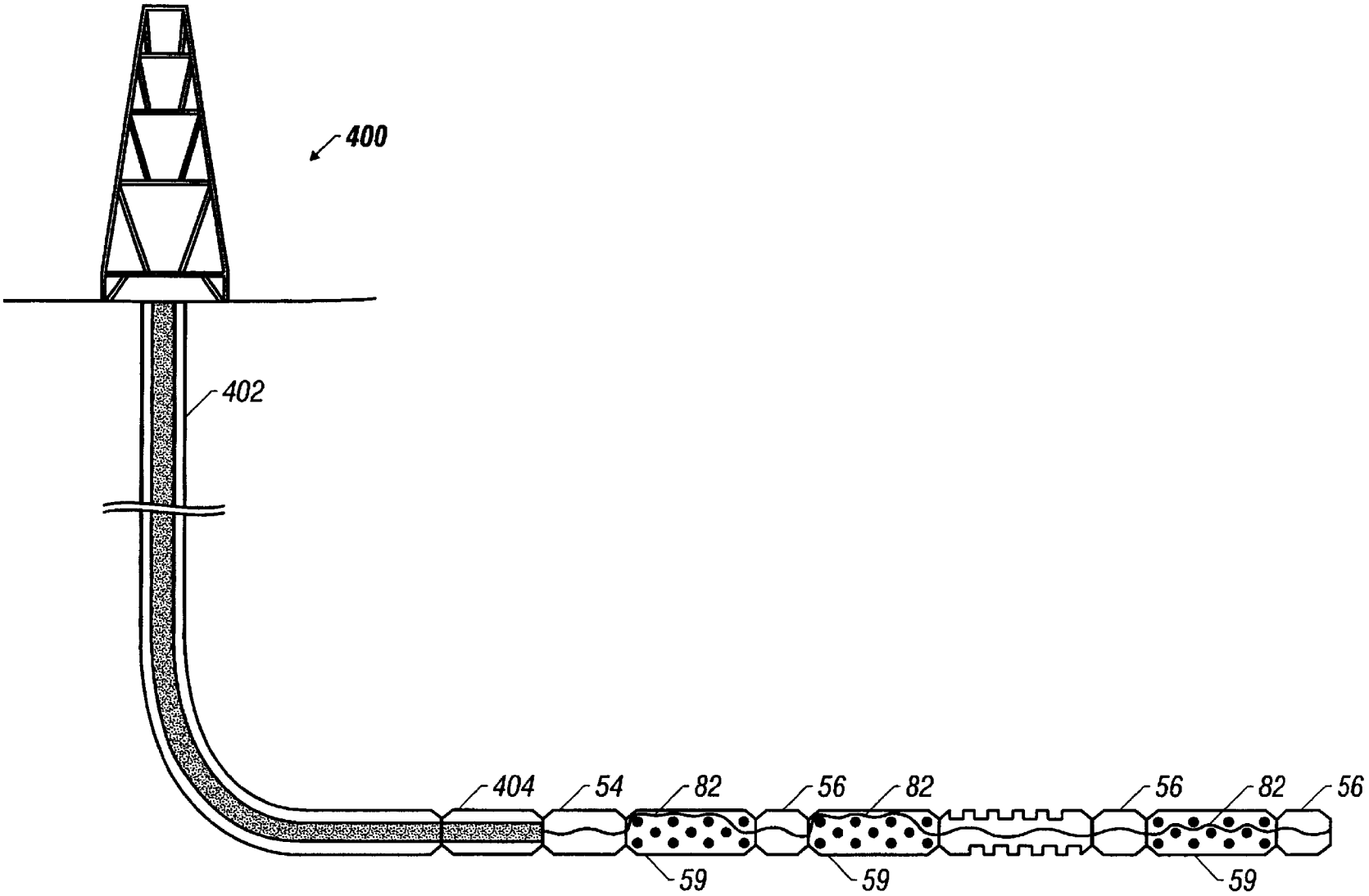
FIG. 18 is a schematic diagram of a perforating gun string according to an embodiment of the invention.
Figure 19:
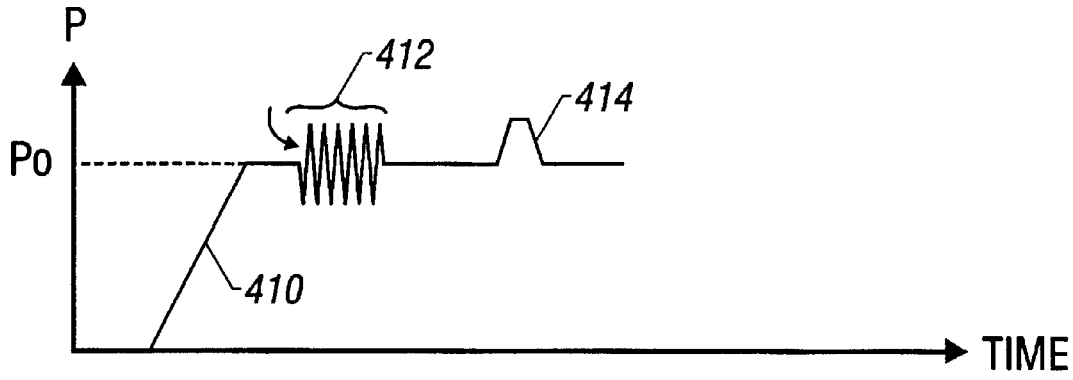
FIGS. 19 and 20 are waveforms of a pressure fluid illustrating stimuli to cause and indicate firing of a perforating gun according to different embodiments of the invention.

Referring to FIG. 18, in some embodiments, the fire control circuit 54, the perforating guns 59 and the initiator modules 56 may form part of a string 402 of a system 400. In this manner, the system 400 does not include a packer, and as a result, fluid may be circulated through a circulation valve module 404 between the central passageway of the string 402 and an annulus that surrounds the string 402. Referring also to FIG. 19, the fire control circuit 54 may operate the circulation valve module 404 to indicate the firing of a particular perforating gun 59. In this manner, a pressure P of the circulating fluid may be increased (as indicated by a pressure ramp 140) by restricting the flow to increase the pressure P to a baseline pressure level $P_0$. Next, the flow is restrictively altered to cause pressure pulses 412 in the fluid that indicate the detonation command for a particular perforating gun 59. In some embodiments, after the targeted perforating gun 59 fires, the fire control circuit 54 recognizes this occurrence and causes the circulation valve module 404 to momentarily close to increase the pressure in the tubing to generate a positive pressure pulse 414 (relative to the baseline pressure $P_0$), a stimulus that propagates to the surface of the well to indicate firing of the perforating gun 59.

Figure 20:
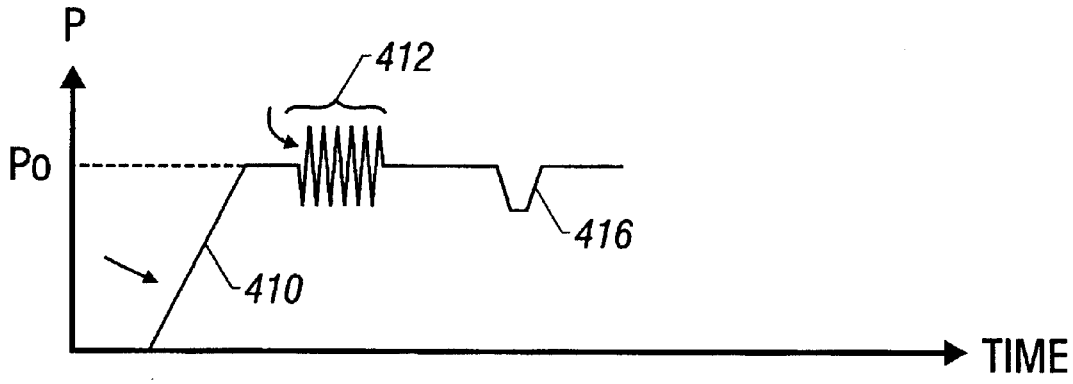

In some embodiments, the fluid does not circulate through the central passageway of the string 402 and the annulus, as described above. Instead, the fluid is generally stationary inside the central passageway of the tubing 402, and after the firing of the perforating gun 59, the fire control circuit 54 causes the circulation valve module 404 to momentarily open to generate a negative pressure pulse 416 (relative to the baseline pressure $P_0$), as depicted in FIG. 20.

In some embodiments, the circulation valve module 404 includes a pressure sensor to detect the firing of the perforating gun, as described below. In this manner, the circulation valve module 404 may either be notified by the fire control circuit 54 or use the pressure sensor to independently detect the detonation command for a perforating gun 59. The pressure sensor may then monitor the downhole acoustic energy to detect firing of the particular perforating gun 59.

Alternatively, the fire control circuit 54 may determine whether the gun 59 has been fired and then interact with the circulation valve module 404 accordingly. For example, the fire control circuit 54 may include a pressure sensor to detect firing of the perforating gun 59 or may attempt to communicate with the initiator module 56 to verify the firing of the gun 59, as described below.

Figure 17:
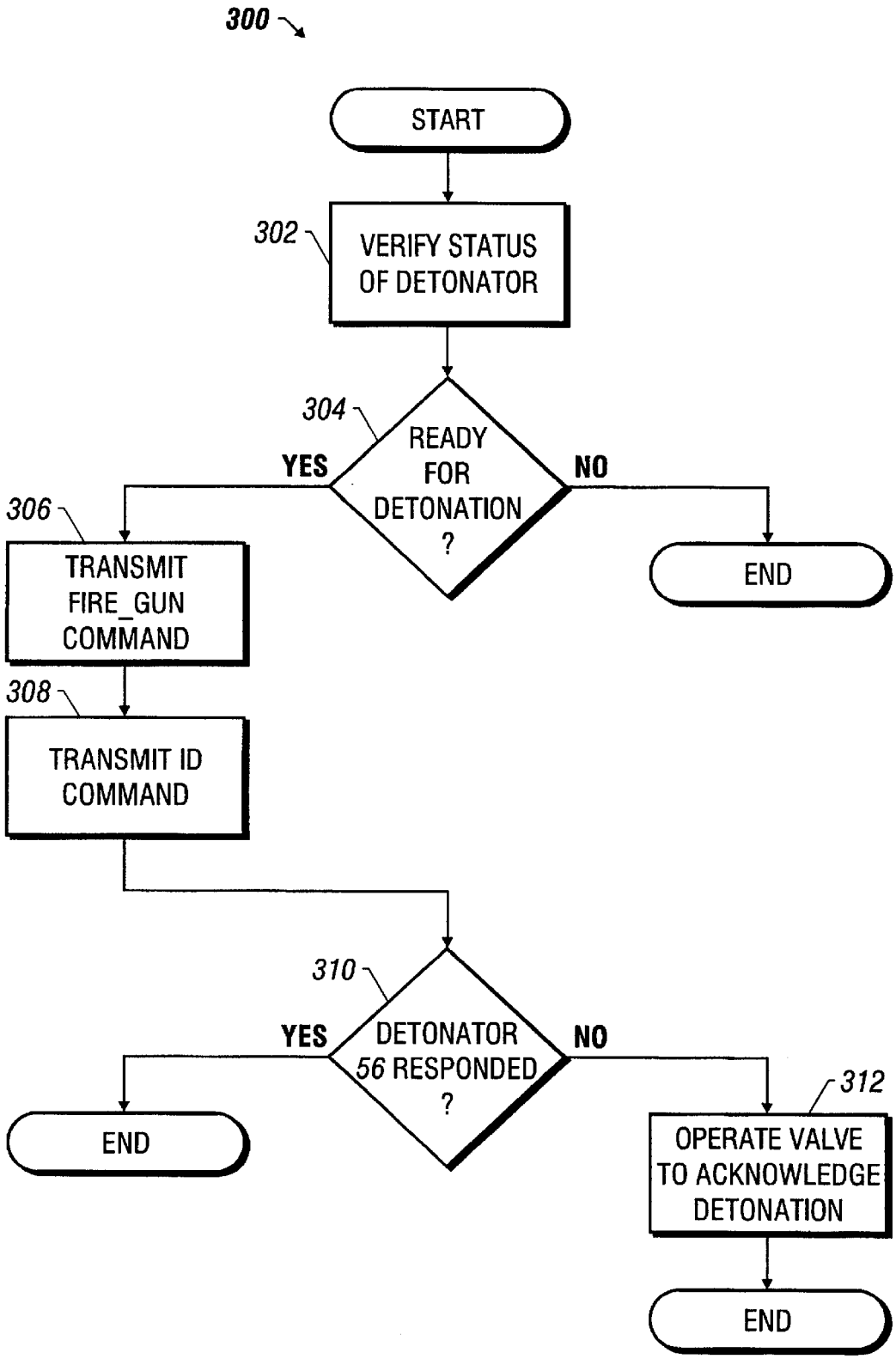
FIG. 17 is a flow diagram illustrating an algorithm to indicate the firing of a particular perforating gun.

Referring to FIG. 17, in this manner, the fire control circuit 54 may execute an algorithm 300 to fire the selected perforating gun 59. First, the fire control circuit 54 may verify (block 302) the status of the associated initiator module 56 by communicating with the initiation control circuit 61 of the initiator module 56. Based on the information communicated from the initiation control circuit 61, the fire control circuit 54 determines (diamond 304) whether the initiator module 56 is ready to be detonated. If not, in some embodiments, the fire control circuit 54 aborts the detonation and waits for further command(s) from the surface of the well.

If the fire control circuit 54 determines (diamond 304) that the initiator module 56 is ready to be detonated, the fire control circuit 54 transmits (block 306) the FIRE_GUN command to cause the initiator module 56 to fire the perforating gun 59. Afterwards, the fire control circuit 54 attempts to communicate with the initiator module 56. For example, the fire control circuit 54 may transmit an ID command requesting identification information from the initiator module 56. If the fire control circuit 54 determines (diamond 310) that the initiator module 56 did not respond, then the fire control circuit 54 assumes that the perforating gun 59 has fired. In response, the first control circuit 54 operates (block 312) the valve module 404 via control lines 351 (see FIG. 4) to indicate the firing of the perforating gun 59. Otherwise, the fire control circuit 54 assumes that the perforating gun 59 did not fire, and the fire control circuit 54 waits for further command(s) from the surface of the well.

Other arrangements are possible.

Figure 8:
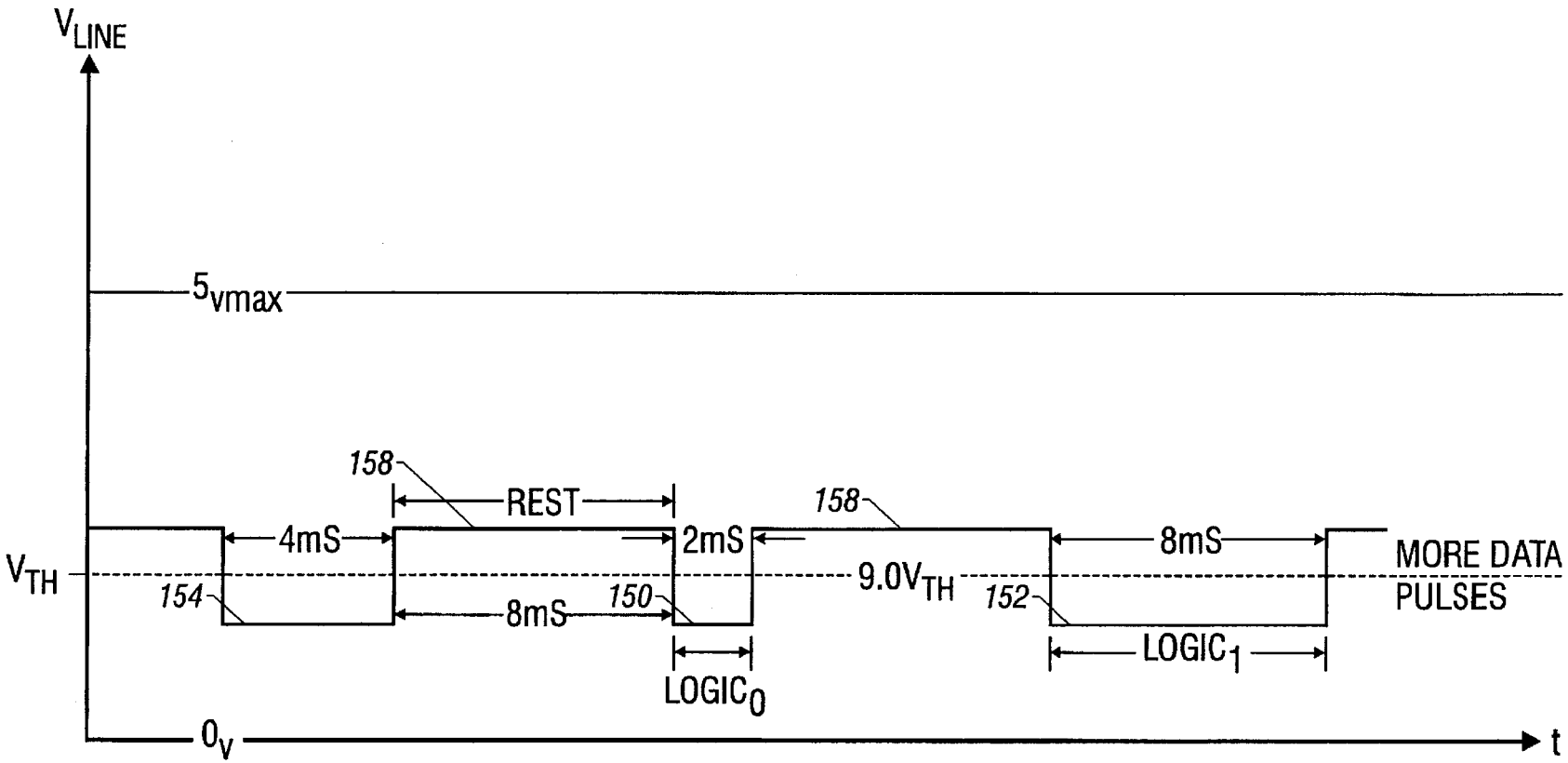
FIG. 8 is a waveform of a signal illustrating a communication protocol between the fire control circuit and the detonators.

Referring to FIG. 8, for communication purposes, a voltage level $V_{LINE}$ of the power line 82 is biased at a threshold voltage level $V_{TH}$ (e.g., nine volts). A logic zero corresponds to the voltage level $V_{LINE}$ being below the voltage level $V_{TH}$ (e.g., eight volts), and a logic one corresponds to the voltage $V_{LINE}$ being above the voltage $V_{TH}$ (e.g., ten volts). Besides the logical voltage levels, several other measures are in place to maximize the accuracy of serial communications with the initiator modules 56. For example, the duration of a logic zero pulse 150 is one third the duration of a logic one pulse 152. All pulses (i.e., logic one or logic zero pulses) are separated by a separation pulse (a pulse having a logic one voltage level) that has a duration equal to sum of the durations of the logic zero 150 and logic one 152 pulses. The voltage level $V_{LINE}$ is normally at the logical one level if the line 82 is not negated (i.e., pulled to the logic zero voltage level) by one of the initiator modules 56 or the fire control circuit 54. To indicate the beginning of a serial transmission, the line 82 is negated for a start pulse 154 that is twice the duration of the logic zero pulse 150.

Referring to FIG. 9, to minimize the possibility of connection of the battery 52 to the initiator modules 56 due to partial or total failure of the fire control circuit 54, the fire control circuit 54 has two circuits 100 and 102 which must both independently verify reception of the detonation command before the battery 52 is connected to the initiator modules 56. In this manner, no perforating guns 59 may be fired if one of the circuits 100 or 102 fails and incorrectly verifies reception of the detonation command. To accomplish this, the circuit 100 controls a switch 108 that is coupled in series with the battery 52 (and line 82) and a switch 112 that is coupled in parallel with the battery 52. Similarly, the circuit 102 controls a switch 106 that is coupled in series with the battery 52 (and line 82) and a switch 110 that is coupled in parallel with the battery 52. Thus, to connect the battery 52 to the initiator modules 56, the parallel switches 110 and 112 must be opened, and subsequently, the series switches 106 and 108 must be closed.

After initial power-up of the circuitry of the tool, the circuits 100 and 102 enter a safe state (the state of the fire control circuit 54 before the tool is lowered downhole) in which the circuits 100 and 102 ensure that the series switches 106 and 108 are open and the shunt switches 110 and 112 are closed. The circuits 100 and 102 remain in the safe state (assuming no malfunction in the fire control circuit 54 occurs) until the circuits 100 and 102 open the parallel switches 110 and 112 and close the series switches 106 and 108. If both circuits 100 and 102 do not enter the safe state after reset, fault detection logic 130 closes another switch 112 (normally open) that is in parallel with the battery 52 to blow the fuse 80 ( see FIG. 4).

The circuit 100 has the processor 120 (an eight bit microcontroller, for example) that interacts with the sensor (s) 53 to detect the stimuli transmitted downhole. Based on the detected stimuli, the processor 120 extracts the command(s) transmitted from the surface of the well and thus, eventually extracts the detonation command.

Referring also to FIGS. 10, 11 and 12, to ensure that the processor 120 is not malfunctioning, the circuit 100 has a timer 122 that is used to establish a time interval window 140 (as indicated by an output signal of the timer 122 called EN1) of a predetermined duration (e.g., sixty-four seconds) in which the battery 52 is to be connected to the initiator modules 56 (i.e., switch 108 is closed and switch 112 is opened) and in which the perforating guns 59 are to be fired. When the processor 120 detects the detonation command, the processor 120 enables the timer 122 to measure a time interval T1 of a predetermined duration (e.g., sixty-four seconds). The window 140 begins (as indicated by the assertion of the EN1 signal) when the time interval T1 elapses.

While the timer 122 is measuring the time interval T1, the processor 120 is internally and independently measuring another time interval T2 of a predetermined duration (e.g., sixty-five seconds) that is slightly longer in duration (e.g., one second longer) than the time interval T1. At the end of the time interval T2, the processor 120 attempts to open the parallel switch 112. If the window 140 exists, switch logic 124 allows the processor 120 to open the parallel switch 112. Otherwise, the switch logic 124 keeps the parallel switch closed 112.

After the time interval T2 elapses, the processor 120 measures another successive time interval T3 of a predetermined duration sufficient to allow the parallel switch 112 to open (e.g., 10 $\mu$s) before attempting to close the series switch 108. If the window 140 exists, the switch logic 124 allows the processor 120 to close the series switch 108. Otherwise, the switch logic 124 keeps the series switch 108 open.

After the time interval T3 elapses, the processor 120 measures another successive time interval T4 of a predetermined duration (e.g., thirty-one seconds) which is equivalent to the time left in the window 140. Just before (e.g., 10 $\mu$s before) the time interval T4 elapses, the processor 120 opens the series switch 108 (if not already open). When the time interval T4 expires, the processor 120 closes the parallel 112 (if not already closed) which returns the circuit 100 to the safe state.

The circuit 102 has a processor 126, switch logic 128, and a timer 129 that behave similarly to the processor 120, switch logic 124, and timer 122, respectively, to control the series switch 106 and the parallel switch 110. Instead of monitoring the output of the sensor 53 directly, the processor 126 receives an indication of the output of the sensor 53 from the processor 120 and independently verifies the signature of the pulses present in the hydrostatic fluid in the annulus 46 to extract commands sent from the surface of the well.

The processor 120 may include a non-volatile internal memory (an EPROM memory, for example) or may be coupled to a non-volatile external memory that stores a program 352 that causes the processor 120 to, when the processor 120 executes the program, perform the functions described above. In this manner, the program 352 may also cause the processor 120 to perform the algorithm 300 (described above) and use the control lines 351 to operate the valve 350.

To verify that both circuits 100 and 102 come up in the safe state after power up of the fire control circuit 54, the fault detection logic 130 monitors the outputs (CMD1[15:0] and CMD2[15:0]) of the processors 120 and 126 to ensure these outputs indicate the processors 120 and 126 are in the safe state (e.g., "10100101b," wherein the suffix "b" denotes a binary representation). The fault detection logic 130 also monitors the output of an oscillator 115 which is used to clock the counters 122 and 129 and the processors 120 and 126. In this manner, if the fault detection logic 130 detects failure of the oscillator 115, the fault detection logic 130 closes the parallel switch 112 which blows the fuse 80. As a result, if the oscillator 115 temporarily fails while the tool 50 is downhole and the fire control circuit 54 is not in the safe state, the battery 52 does remain connected to any of the initiator modules 56 should the oscillator 115 revive after the tool 50 is brought to the surface. The fault detection logic 130 also receives the outputs of several water sensors 131 selectively placed around the circuitry of the tool 50. In this manner, if water is detected in the presence of the circuitry of the tool 50, the fault detection logic 130 closes the parallel switch 112 and blows the fuse 80. The fault detection logic 130 also monitors the terminal voltage of the battery 52 (as indicated by a signal called $V_{BAT}$) and closes the switch 112 should the terminal voltage exceed predetermined limits.

The fire control circuit 54 has a transmitter 116 and a receiver 118 which the processor 120 uses to serially communicate over the line 82 with the initiation control circuits 61 of the initiator modules 56. The input of the receiver 118 and the output of the transmitter 116 are connected to the output side of a current limiter 114 that is serially coupled between switch 108 and line 82. When fire control circuit 54 has completed the communication protocol, fire control circuit 54 applies full battery 52 power to initiation control circuits 61 by closing a bypass switch 115 to fire the associated perforating gun 59.

Referring to FIG. 13, as an example of the structure of the switches, the switch 106 may have a driver circuit 183 that has output terminals that are coupled to the gate and source of an n-channel metal oxide field-effect (NMOS) transistor 184. The current path of the transistor 184 is coupled between the line 81 and the current path of switch 108. The input of the drive circuit is connected to the switch logic 128.

Alternatively, as another example, the switch 106 may include an NMOS transistor 300 that has its drain-source path coupled between the line 81 and the switch 108. The gate-source voltage across the transistor 300 may be established by a resistor 302 that has one terminal coupled to the gate and one terminal coupled to the source of the transistor 300. Another NMOS transistor 304 of the switch 106 may have its drain-source path coupled between the gate of the transistor 300 and ground The gate of the transistor 304 may be coupled to the switch logic 128.

The other switches 108, 110 and 112 may be constructed in a similar manner to the switch 106. Each switch 106, 108, 110, 112 has two states: an open state (in which the switch does not conduct) and a closed state (in which the switch conducts). The connection (i.e., a serial connection or a parallel connection) of the switch 106, 108, 110, 112 governs which state of a particular switch permits energy to flow from the battery 52 to the initiator module 56.

Figure 15:
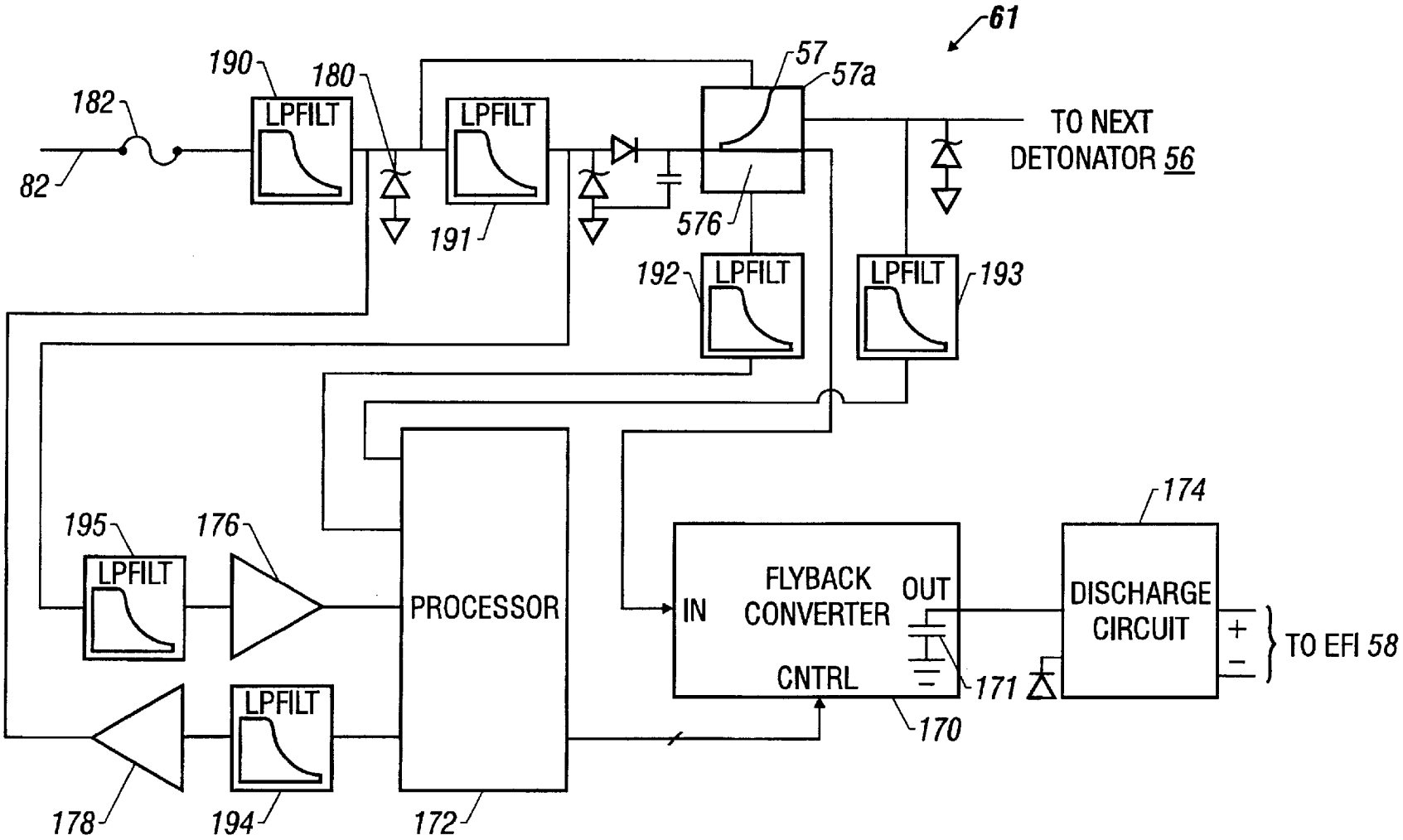
FIG. 15 is an electrical schematic diagram of the initiation control circuit of FIG. 4.

Referring to FIG. 15, in some embodiments, each initiation control circuit 61 may have a processor 172 that controls a switch circuit 57 (including the switches 57*a* and 57*b*) as well as operations of a fly-back, switching converter 170 (used to boost the voltage of the battery 52) and communications with the fire control circuit 54. The communications of the initiation control circuit 61 are accomplished via a receiver 176 and a transmitter 178 which are coupled to the line 82 and the processor 172.

When power is applied to initiation control circuits 61, the default setting of switch 57*a* is open to disconnect the initiation control circuit 61 from the other initiator modules 56, and the switch 57*b* is closed to power the immediate initiation control circuits 61 when instructed to do so by the fire control circuit 54. When the switch circuit 57 opens the switch 57*a*, the switch circuit 57 also closes the switch 57*b* which connects the battery 52 to the converter 170. Upon this occurrence, the processor 172 interacts with the converter 170 to boost the terminal voltage level of the battery 52 to a higher voltage level which is present at the output of the converter 170. A discharge circuit 174 (a gas discharge tube, for example) discharges an output capacitor 171 of the converter 170 when the output voltage of the converter 170 reaches a predetermined level (three thousand volts, for example). In this manner, the discharge circuit 174 transfers energy from the capacitor 171 to activate the EFI 58. Once activated, the EFI 58 initiates a shockwave in the detonator cord 51.

To minimize unpredictable behavior of the initiation control circuit 61, the initiation control circuit 61, in some embodiments, includes six low pass filters 10, 191, 192, 193, 194 and 195 that are selectively placed around the circuitry of the initiation control circuit 61 to reduce the level of any stray radio frequency (RF) signals. The initiation control circuit 61 also has an in-line fuse 182 coupled in series with the battery 52 and a Zener diode 180 shunted to ground to guard against such possibilities as the polarity or voltage level of the battery 52 being incorrect.

Figure 16:
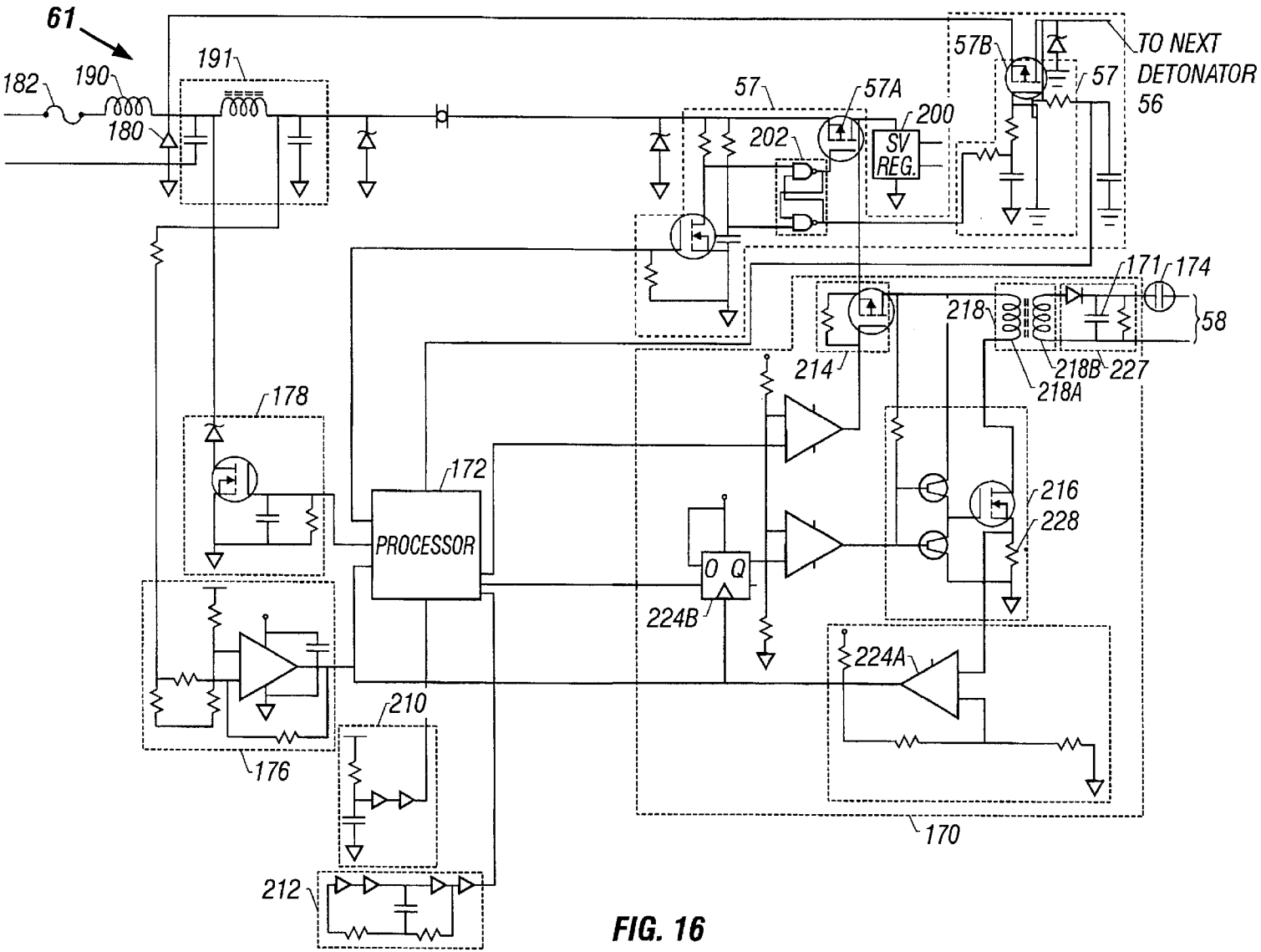
FIG. 16 is a more detailed electrical schematic diagram of the initiation control circuit of FIG. 15.

Referring to FIG. 16, the processor 172 may control the fly-back converter 170 by using two switches 214 and 216 to switch current through a primary winding 218*a* of a transformer 218 of the converter 170. The switch 214 may be a simple redundant (backup safety switch) that is switched on and off by the processor 172.

The processor 172 closes the switch 216 (i.e., turns on current in the primary winding 218*a*) at a predetermined rate by a clocking latch 224*b*. A sensing resistor 228 is coupled to the input of a comparator 224*a* which provides a reset to a latch 224*b* when the current in the primary winding 218*a* exceeds a predetermined threshold level. Upon this occurrence, the latch 224*b* opens the switch 216 which turns off current in the primary winding 218*a*. Subsequently, after waiting a predetermined duration, the processor 172 closes the switch 216 and repeats the above-described control process.

When current in the primary winding 218*a* is disrupted (i.e., by the opening of the switch 216), the energy stored in the transformer 218 is transferred to a secondary circuit 222 (having the capacitor 171) that is coupled to a secondary winding 218*b* of the transformer 218. On each power cycle of the converter 170, additional energy (corresponding to a step up in the voltage level of the capacitor 171) is transferred to the capacitor 171. When the voltage level of the capacitor 171 is large enough to activate the discharge circuit 174, the EFI 58 is activated which sends a shockwave down the detonator cord 51.

The switch circuit 57 has a two NAND gate latch 202 which controls the switches 57*a* and 57*b*. On power up, switch 57*a* is closed and switch 57*b* is open by default. In some embodiments, the processor 172 can only change the state of latch 202 to open switch 57*a* and close 57*b*. Only a new power up cycle can reset the latch 202. Once the switch 57*a* is open, no power is available for processor 172 to control anything.

The initiation control circuit 61 also has an RC ring-type oscillator 212 which provides a clock signal used by the circuitry of the initiation control circuit 61. A reset circuit 210 momentarily places the processor 172 in reset after power up of the initiation control circuit 61. The initiation control circuit 61 has a voltage regulator 200 to furnish direct current (DC) voltage for the logic of the initiation control circuit 61.

Figure 21:
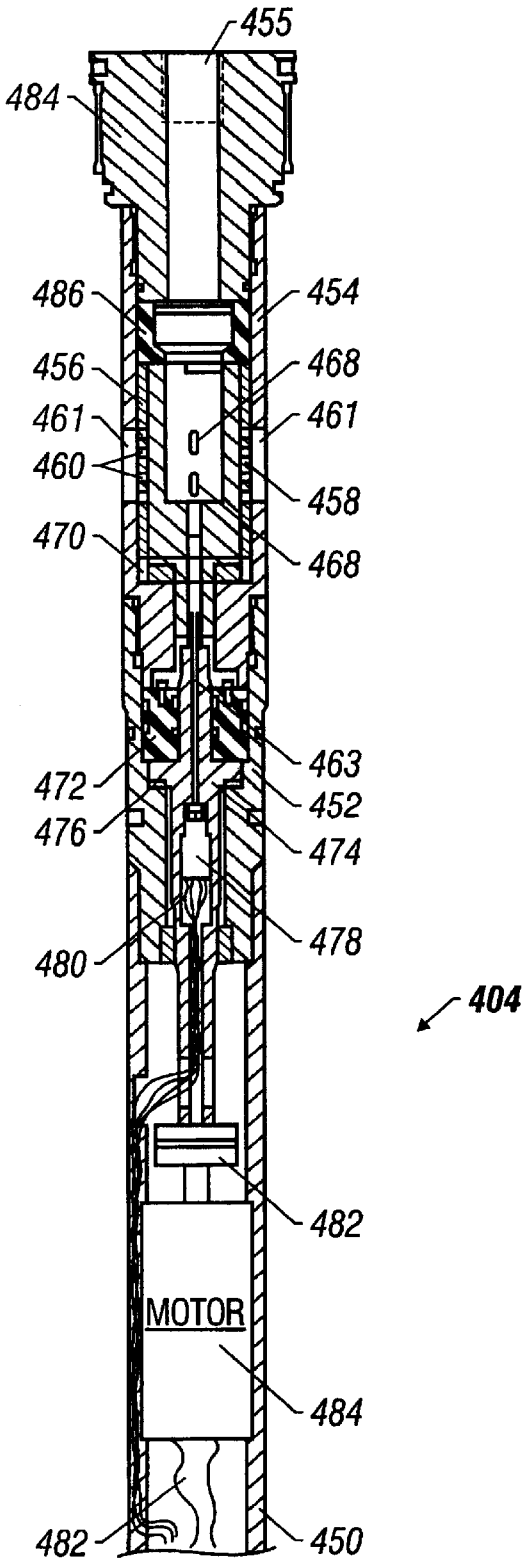
FIG. 21 is a cross-sectional view of a valve of the perforating gun string of FIG. 18 according to an embodiment of the invention.

Referring to FIG. 21, in some embodiments, the valve module 404 may be formed from three concentric housings 450, 452 and 454. In this manner, the housing 450 may be near the end (of the valve module 404) that is closest to the fire control circuit 54 and may be threadably coupled to the housing 452. The housing 452, in turn, may be threadably coupled to the housing 454 that is near the end (of the valve module) that is farthest from the fire control circuit 54. A concentric coupler 484 may secure the housing 454 to the tubing of the string 402, and the housing 450 may be attached (via another coupler, for example) to a module that houses the fire control circuit 54.

The housing 454 includes radial ports 461 that establish fluid communication with radial ports 460 of a fixed slotted sleeve 456 that is concentric with and resides inside the housing 454. A rotating slotted sleeve 458 is concentric with and located inside the fixed slotted sleeve 456, and a central passageway of the sleeve 458 establishes fluid communication with the central passageway of the string 402 via a central passageway 455 of the coupler 484. In an open position of the valve module 404, radial ports 468 of the sleeve 458 align with the radial ports 460 of the sleeve 456, an alignment that establishes fluid communication between the annulus and central passageway of the string 402. The sleeve 458 may be rotated ninety degrees to place the valve module 404 in a closed position, a position in which the non-slotted portions of the sleeve 456 block fluid communication through the radial ports 468 of the sleeve 458.

An electric motor 484 that is housed inside the housing 450 furnishes the torque for rotating the sleeve 458 and thus, for opening and closing the valve module 404. A shaft of the motor 484 may be coupled to one end of a drive shaft 474 of the valve module 404 via a flexible shaft coupling 482. The other end of the drive shaft 474, in turn, is coupled to the sleeve 458.

In some embodiments, the drive shaft 474 has a central passageway 463 that is in fluid communication with the central passageway of the sleeve 458. Due to this arrangement, a pressure sensor 478 may close off the central passageway 463 and thus, may be used to sense the pressure of the fluid inside the string 402. Wires 480 may extend from the pressure sensor 478, through the remaining portion of the central passageway 463 and to the fire control circuit 54 that may, for example, use signals from the wires 480 to detect the pressure of the fluid.

Among the other features of the valve module 404, a retaining nut 486 that is concentric with the housing 454 may be threadably secured to the housing 454 to hold the sleeves 456 and 458 in place. Annular teflon bearings 470 may be used to reduce frictional forces between the sleeve 458 and the housing 454. The housing 452 may contain an annular rotating seal fixture 472 that radially surrounds a portion of the drive shaft 474. The housing 452 may also include a thrust bearing seal 476 that is located between the drive shaft 474 and the housing 452. Electronics of another module (not shown) may use the wires 482 to control the motor 484 and thus, the valve module 404. For example, the fire control circuit 54 may control a driver board (not shown) that furnishes high current buffers to drive the motor 484.

Other embodiments are within the scope of the following claims. For example, the initiation control circuit 61 may fire downhole devices other than the associated perforating gun 59, such as a single shot device (a packer, for example).

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system for use in a subterranean well, comprising:

a valve located downhole and in communication with a generally hydrostatic column of fluid extending to a surface of the well;

a downhole device; and circuitry coupled to the downhole device and valve, the circuitry adapted to operate the valve to transmit a stimulus through the fluid to the surface of the well to indicate a state of the downhole device.

2. The system of claim 1, wherein the downhole device performs a downhole function and the circuitry is adapted to operate the valve to transmit the stimulus to indicate whether the downhole device has performed the function.

3. The system of claim 2, wherein the circuitry is adapted to operate the valve to transmit the stimulus if the circuitry determines that the downhole device has performed the function.

4. The system of claim 1, wherein the circuitry is adapted to at least open the valve to transmit the stimulus.

5. The system of claim 1, wherein the circuitry is adapted to at least close the valve to transmit the stimulus.

6. The system of claim 1, wherein the circuitry is further adapted to communicate with downhole device to at least attempt to cause the device to perform a downhole function.

7. The system of claim 1, wherein the downhole device comprises:

a detonator;

a firing head; and a communication link to establish communication between the detonator and the firing head to fire the firing head.

8. The system of claim 7, wherein the circuitry is adapted to operate the valve to indicate when the firing head fires.

9. The system of claim 7, wherein the firing of the firing head disrupts the communication between the circuitry and the detonator via the communication link, and the circuitry is adapted to attempt to communicate with the detonator via the communication link to determine whether the firing head has fired.

10. The system of claim 1, wherein the valve comprises an electrically controlled circulation valve.

11. The system of claim 1, wherein the circuitry comprises a microcontroller.

12. The system of claim 1, wherein the stimulus comprises a pressure pulse.

13. The system of claim 1, wherein the circuitry is part of a module that includes the valve.

14. The system of claim 1, wherein the downhole device comprises a perforating gun, and the circuitry operates the valve to indicate whether the perforating gun has fired.

15. A method usable with a subterranean well, comprising:

determining a state of a downhole device; and based on the determination, operating a valve to transmit a stimulus through a generally hydrostatic column of fluid to the surface of the well to indicate the state.

16. The method of claim 15, wherein the act of operating comprises:

using the valve to transmit the stimulus if the downhole device has performed a predefined operation.

17. The method of claim 16, wherein the operation comprises a perforating operation.

18. The method of claim 15, wherein the act of operating comprises:

at least opening the valve.

19. The method of claim 15, wherein the act of operating comprises:

at least closing the valve.

20. The method of claim 15, further comprising:

communicating with the downhole device from the surface to at least attempt to cause the downhole device to perform a predefined function.

21. The method of claim 15, wherein the downhole device comprises a perforating gun.

22. A system for use in a subterranean well, comprising:

a device located downhole and in communication with a generally hydrostatic column of fluid extending to a surface of the well; and circuitry coupled to the downhole device and adapted to operate the device to transmit a stimulus through the fluid to the surface of the well to establish communication uphole.

23. The system of claim 22, further comprising:

a downhole tool to perform a downhole function, wherein the circuitry is adapted to operate the device to transmit the stimulus to indicate whether the downhole tool has performed the function.

24. The system of claim 22, wherein the device comprises a valve.

25. The system of claim 24, wherein the circuitry is adapted to at least open the valve to transmit the stimulus.

26. The system of claim 24, wherein the circuitry is adapted to at least close the valve to transmit the stimulus.

27. The system of claim 23, wherein the circuitry is further adapted to communicate with downhole device to at least attempt to cause the device to perform a downhole function.

28. The system of claim 23, wherein the downhole device comprises:

a detonator;

a firing head; and a communication link to establish communication between the detonator and the firing head to fire the firing head.

29. The system of claim 28, wherein the circuitry is adapted to operate the device to indicate when the firing head fires.

30. The system of claim 28, wherein the firing of the firing head disrupts the communication between the circuitry and the detonator via the communication link, and the circuitry is adapted to attempt to communicate with the detonator via the communication link to determine whether the firing head has fired.

31. The system of claim 22, wherein the stimulus comprises a pressure pulse.

32. A method comprising:

operating downhole device to transmit a stimulus through a generally hydrostatic column of fluid to the surface of a well to establish communication between the device and the surface.

33. The method of claim 32, wherein the downhole device comprises a valve.

34. The method of claim 32, further comprising:

using the operation of the downhole device to communicate an indication of a downhole state to the surface of the well.

35. The method of claim 34, wherein the downhole state comprises a state of a downhole tool.

36. The method of claim 32, wherein the stimulus comprises a pressure pulse.

37. The method of claim 32, wherein the operating comprises:

operating the downhole device to indicate whether a perforating gun has fired.

* * * * *